US006887032B2

(12) United States Patent
Favre-Felix et al.

(10) Patent No.: US 6,887,032 B2
(45) Date of Patent: May 3, 2005

(54) TURBO/DRAG PUMP HAVING A COMPOSITE SKIRT

(75) Inventors: Lionel Favre-Felix, Annecy (FR); Olivier Dauvillier, Marcellaz Albanais (FR); André Bouille, Annecy (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/682,200

(22) Filed: Oct. 10, 2003

(65) Prior Publication Data

US 2004/0076510 A1 Apr. 22, 2004

(30) Foreign Application Priority Data

Oct. 11, 2002 (FR) ..... 02 12693

(51) Int. Cl.[7] ..... F01D 1/36

(52) U.S. Cl. ..... 415/90; 415/143; 415/200; 416/230; 416/241 A; 242/437; 242/439.5; 242/444

(58) Field of Search ..... 415/90, 143, 200; 416/230, 241 A, 244 R; 417/423.4; 242/437, 439.5, 443, 444

(56) References Cited

U.S. PATENT DOCUMENTS

| | | | | | |
|---|---|---|---|---|---|
| 1,723,261 | A | * | 8/1929 | Varley | 242/444 |
| 2,498,674 | A | * | 2/1950 | Graham et al. | 242/444 |
| 3,386,872 | A | * | 6/1968 | Medney | 416/241 A |
| 3,801,029 | A | * | 4/1974 | Malburg | 242/444 |
| 4,562,975 | A | * | 1/1986 | Wackerle et al. | 242/437 |
| 5,462,402 | A | * | 10/1995 | Bakholdin et al. | 415/90 |
| 5,733,104 | A | * | 3/1998 | Conrad et al. | 417/423.4 |
| 5,772,395 | A | * | 6/1998 | Schofield | 415/90 |
| 6,343,910 | B1 | * | 2/2002 | Kawasaki et al. | 415/90 |
| 6,599,084 | B1 | * | 7/2003 | Schutz et al. | 415/90 |
| 6,779,969 | B2 | * | 8/2004 | Nonaka et al. | 415/90 |
| 2002/0054815 | A1 | | 5/2002 | Kawasaki | |

FOREIGN PATENT DOCUMENTS

| | | |
|---|---|---|
| DE | 199 15 307 A | 10/2000 |
| EP | 0 603 694 A | 6/1991 |

* cited by examiner

*Primary Examiner*—Christopher Verdier
(74) *Attorney, Agent, or Firm*—Sughrue Mion, PLLC

(57) ABSTRACT

There is provided a rotor for a turbo/drag vacuum pump, the rotor comprising an upstream rotor segment of the turbine type made of metal or alloy, and a downstream rotor segment of Holweck type made of composite material. The downstream segment of the rotor has a reinforcing structure made of long fibers that are distributed in a manner that varies as a function of the section under consideration: in the annular connection region connected to the upstream segment of the rotor, the fibers are inclined and/or spaced apart in order to conserve sufficient flexibility for the composite material to enable it to deform so as to track deformation of the metal of the upstream rotor segment while it is in operation; in contrast, the fibers are close together and form turns that touch in the downstream region of the skirt, thereby guaranteeing greater stiffness in order to withstand the mechanical stresses that occur during high-speed rotation of the rotor in operation. It is thus possible to make a rotor with a Holweck type skirt that is of greater diameter, thereby improving the properties of the pump.

9 Claims, 6 Drawing Sheets

TURBO/DRAG PUMP HAVING A COMPOSITE SKIRT

The present invention relates to vacuum pumps that rotate at high speed to generate a high vacuum in a vacuum pipe and/or a vacuum enclosure.

BACKGROUND OF THE INVENTION

In the electronic or micromechanical components industries, machining or plasma treatment processes are used that are performed in an enclosure where it is necessary to maintain a controlled vacuum atmosphere.

Generating a vacuum requires pumps to be used that are capable of generating quickly a high vacuum that is suitable for the machining or treatment process, and that are capable of maintaining it. In general, turbo/drag type pumps are used, comprising a pump body in which a rotor is caused to rotate rapidly, for example rotation at more than 30,000 revolutions per minute (rpm).

With such a high speed of rotation, the rotor acquires very high kinetic energy, and is subjected to high mechanical stresses which require suitable materials to be selected.

The rotor of a turbo/drag vacuum pump is constituted by a segment of the rotor that is upstream (in the gas flow direction) and that has turbine type blades, and a segment of the rotor that is downstream (in the gas flow direction) and that is in the form of a Holweck type skirt.

In the description and the claims, the terms "upstream" and "downstream" designate respectively those portions of the vacuum pump that are passed through initially and finally by the gas pumped in the direction in which the gas flows in operation.

The upstream segment having turbine type blades is complex in shape, and is made out of a suitable metal such as aluminum or an aluminum alloy. Its shape is too complex to enable it to be made economically out of composite material.

The downstream segment, in the form of a Holweck type skirt, is a thin wall in the form of a body of revolution, largely cylindrical in shape, and driven to rotate in a downstream segment of a stator having helical grooves of progressively tapering section.

At present, the pumping performance of turbo/drag pumps at high speeds of rotation is limited by the fact that it is not possible to increase the diameter of the Holweck skirt beyond a maximum limit. A priori, it is known that it is possible to increase pumping performance by increasing the diameter of the Holweck skirt. However such an increase turns out to be impossible to achieve while using conventional materials, in particular metals, or even composite materials based on a metal matrix and containing reinforcing additives such as ceramics, powders, or fibers of carbon or other reinforcing materials. The highest mechanical stresses appear in this region of the rotor and they are proportional to the density of the material constituting the skirt, to the square of the speed of rotation of the rotor, and to the square of the diameter of the rotor.

In order to reduce stresses in the Holweck skirt, it is necessary in particular to reduce its mass. To do this, proposals have already been made for rotors in which the downstream segment in the form of a Holweck skirt is made of an organic matrix composite material based on fiber-filled resin. That solution provides the advantage of using a material having better mechanical properties. The downstream segment is connected to the upstream segment via an annular connection region. In this annular connection region, the organic matrix composite material constituting the Holweck skirt is secured to the upstream segment which is made of metal.

However, a difficulty then lies in the differences between the mechanical and thermal properties of the organic matrix composite material constituting the downstream segment of the Holweck skirt rotor and the corresponding properties of the metal or alloy constituting the upstream segment of the rotor. Because of these different properties, large mechanical stresses appear in the annular connection region while the pump is in use, i.e. while the rotor is rotating rapidly in the presence of a rise in temperature due to the pumped gases being compressed. These mechanical stresses lead to weakness of the connection region and to a risk of rupture. Thus, the diameter of this connection region cannot be increased too much.

Conversely, if an organic matrix composite material is used that has mechanical and thermal properties that are more compatible with those of the metal constituting the upstream segment of the rotor, thereby in particular obtaining flexibility capable of accommodating deformation under stress, then the mechanical properties in the downstream region of the Holweck skirt are no longer sufficient to withstand the stresses that need to be supported during high-speed rotation of the rotor.

SUMMARY OF THE INVENTION

The problem posed by the present invention is to devise a novel rotor structure for turbo/drag pumps making it possible, without risk of rotor damage, to withstand higher speeds of rotation or to present a Holweck skirt of larger diameter, in order to improve the pumping characteristics of the pump.

Another object of the invention is to devise such a rotor structure that is capable of being manufactured at lower cost, using a method that is suitable for being industrialized.

The pump of the invention must be capable of withstanding the usual operating conditions, in particular concerning temperature: the rotor must be capable of withstanding temperatures as low as −20° C. during transport, and as high as +150° C. in operation.

The rotor must also present good centering qualities so as to avoid any risk of contact between the rotor skirt and the stator while operating at nominal speed.

The idea on which the invention is based is to devise a Holweck skirt made out of organic matrix composite material that has mechanical characteristics that vary as a function of the longitudinal region under consideration of the skirt.

Thus, the present invention provides a turbo/drag vacuum pump comprising a rotor having an upstream rotor segment of turbine type and a downstream rotor segment in the form of a Holweck type skirt, the upstream rotor segment being made of metal or alloy, the downstream rotor segment being made of organic matrix composite material, and the downstream rotor segment being connected to the upstream rotor segment via an annular connection region. According to the invention:

the downstream rotor segment comprising a Holweck type skirt made of organic matrix composite material has a fiber reinforcing structure imparting mechanical characteristics to the Holweck skirt that vary as a function of the longitudinal region under consideration of the skirt, in the annular connection region, the organic matrix composite material presents mechanical and thermal characteristics close to those of the metal or alloy constituting the upstream rotor segment, in the downstream region of the skirt, the organic matrix composite material presents characteristics that are more suitable for withstanding the high mechanical stresses that result in this downstream region of the skirt from the high-speed rotation of the rotor in operation.

In practice, in order to withstand the high mechanical stresses in the downstream region of the Holweck skirt that result from the high-speed rotation of the rotor in operation, the characteristics that are most appropriate for the organic matrix composite material are high stiffness in order to reduce deformation under stress, and in order to encourage high frequency modes of mechanical resonance.

In a first embodiment, the reinforcing structure comprises long fibers wound helically at constant pitch and coated in resin, the resin fraction varying depending on the longitudinal region under consideration of the skirt.

In another embodiment, the reinforcing structure comprises helically-wound long fibers coated in resin at a constant resin fraction, the pitch of the helix varying depending on the longitudinal region under consideration of the skirt.

In a third embodiment, the reinforcing structure comprises helically-wound long fibers coated in resin, the pitch of the helix and the resin fraction both varying depending on the longitudinal region under consideration of the skirt.

In all or some of the three above embodiments, the variation in pitch associated with the variation in the resin fraction (relative to the total quantity of resin plus fibers) runs the risk of giving rise to variations in the diameter or the thickness of the composite skirt unless suitable precautions are taken. In order to obtain the appropriate outside diameter, particularly in the Holweck portion, it is necessary to have appropriate fabrication tooling. For example, and in non-limiting manner, it is possible to use a mandrel obtained by machining.

In practice, in order to vary the helical pitch in the last two above-mentioned embodiments, the helix may advantageously present an angle close to 0° in the downstream portion of the skirt, and present an angle greater than 0°, e.g. 20° to 30°, in and close to the annular connection region.

The above structure is applicable to various shapes of skirt. In a first embodiment, the skirt may be cylindrical.

Preferably, in order to increase the diameter of the skirt and thus improve the properties of the pump, the skirt may comprise an annular connection region, a downstream segment of cylindrical skirt of diameter greater than the annular connection region, and an intermediate transition region between the annular connection region and the downstream segment of the skirt. Thus, in rotation, the tangential speed of the skirt relative to the stator is increased, thereby increasing the compression ratio of the Holweck stage of the pump. Simultaneously, increasing the diameter makes it possible to accommodate a greater number of grooves in the Holweck portion of the stator, thereby increasing the throughput of the pump.

According to a particular characteristic, the reinforcement fibers may be cut at the upstream edge of the Holweck skirt. This results from an advantageous method of making the Holweck type skirt, the method comprising:

a/ a step consisting in helically winding long fibers on a mandrel, winding at a pitch angle close to 0° in the regions adjacent to the two ends of the mandrel and winding at a pitch angle greater than 0° in the middle region of the mandrel, b/ a step of applying and hardening the resin on the mandrel carrying the helically-wound fibers, and c/ a step consisting in cutting the sleeve as obtained in this way in its middle region in order to obtain two skirts.

BRIEF DESCRIPTION OF THE DRAWINGS

Other objects, characteristics, and advantages of the present invention appear from the following description of particular embodiments, given with reference to the accompanying figures, in which.

DETAILED DESCRIPTION OF THE PREFERRED EMBODIMENTS

Figure 1:
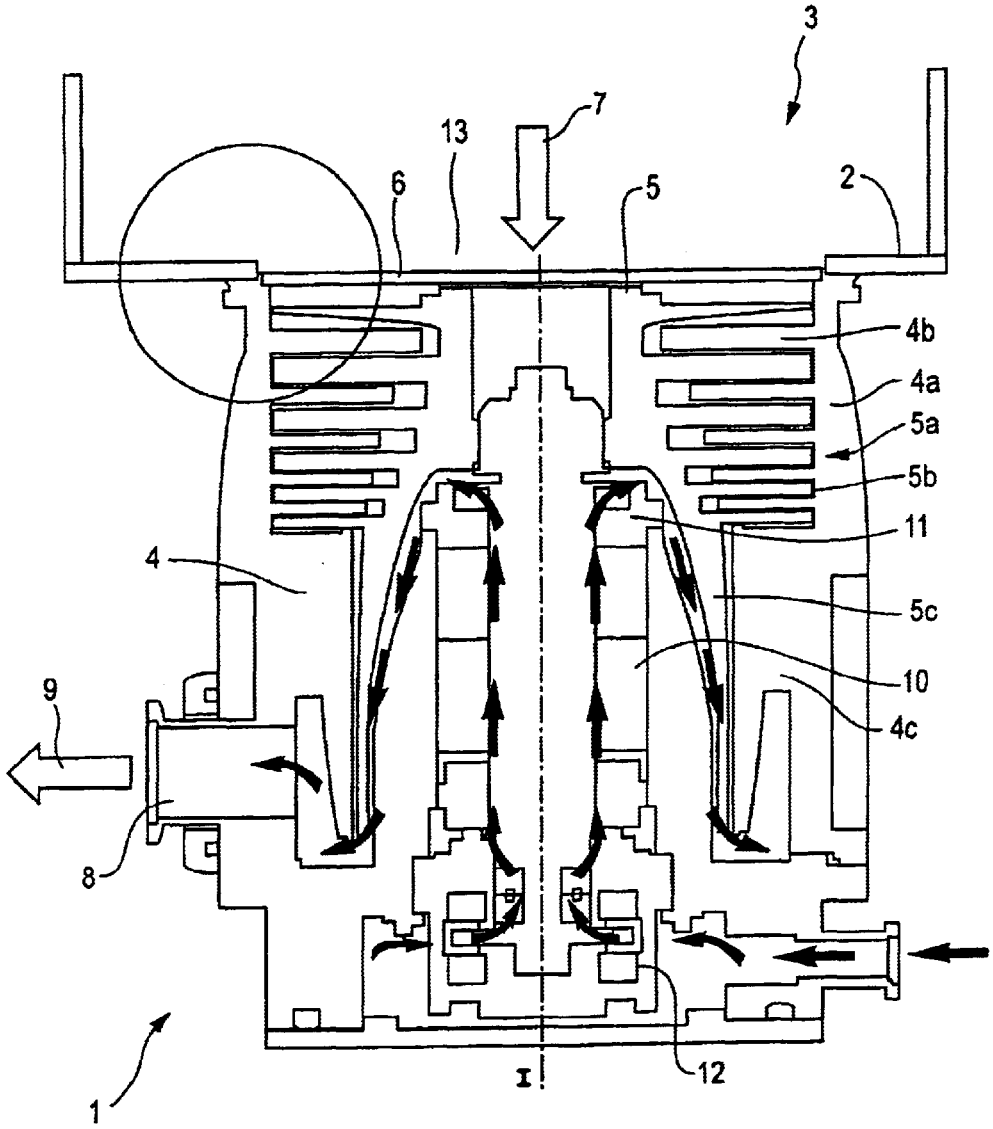
FIG. 1 PRIOR ART
FIG. 1 is a diagrammatic longitudinal section view showing a prior art turbo/drag pump structure having a one-piece rotor made of metal.

Reference is given initially to FIG. 1 showing a turbo/drag pump structure 1 secured to the wall 2 of a vacuum enclosure 3.

The turbo/drag pump 1 comprises a pump body 4 or stator in which a rotor 5 rotates at high speed about an axis of rotation I. The pump body 4 has a coaxial suction orifice 6 through which pumped gases 7 penetrate, and a delivery orifice 8 through which outlet gases 9 are delivered. The rotor 5 is rotated in the pump body 4 by an internal motor 10, and it is guided laterally by magnetic or mechanical bearings 11 and 12.

The wall 2 of the vacuum enclosure 3 has an outlet orifice 13 corresponding to the suction orifice 6 of the vacuum pump 1 and generally constitutes a closed enclosure which is isolated from the outside and in which the vacuum pump 1 can create a controlled vacuum.

The rotor 5 comprises an upstream rotor segment **5*a* having blades such as the blade 5*b*, and it also comprises a downstream rotor segment 5*c* in the form of a Holweck type skirt. Facing the upstream segment 5*a* of the rotor, the stator 4 comprises an upstream stator segment 4*a* having blades such as the blade 4***b*. Facing the Holweck skirt downstream segment 5*c* of the rotor, the stator 4 comprises a downstream stator segment 4*c* having Holweck type helical grooves 4*d* as can be seen more clearly in FIG. 6.

Figure 2:
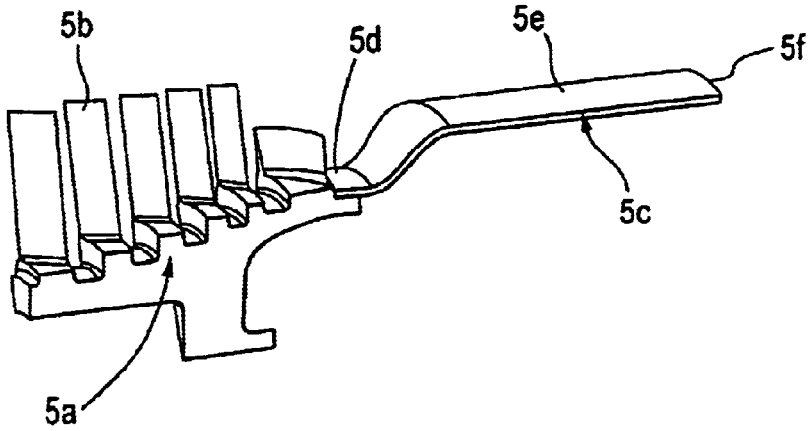
FIG. 2 is a perspective view showing a rotor sector in an embodiment of the present invention.

In FIG. 2, showing a sector of a rotor of the present invention, there can be seen the upstream segment 5*a* of the rotor having blades such as the blade 5*b*, and also the downstream segment 5*c* of the rotor. The upstream rotor segment 5*a* is made of a suitable metal or alloy, e.g. of aluminum or aluminum alloy. The Holweck skirt downstream rotor segment 5*c* is made of an organic matrix composite material based on resin filled with reinforcing fibers. The Holweck skirt downstream segment 5*c* is connected to the upstream segment 5*a* via an annular connection region 5*d*.

The reinforcing fibers may advantageously be glass fibers or carbon fibers and they are in the form of long pieces of roving (up to several thousand filaments per piece of roving) wound continuously on a core by a filamentary winding method. The resins may be thermoplastic resins (e.g. polyether ether ketone (PEEK)) or thermosetting resins (e.g. epoxy resin).

In the invention, the Holweck skirt downstream rotor segment 5*c* of organic matrix composite material comprises a fiber-reinforced internal structure giving the skirt mechanical characteristics that vary as a function of the longitudinal region under consideration of the skirt. The stiffness of the organic matrix composite material is caused to increase in the downstream region 5*e* of the skirt or in the cylindrical segment adjacent to the downstream end 5*f* of the rotor 5 so as to enable it to withstand the high levels of mechanical stress that occur during high-speed rotation of the rotor 5. Simultaneously, greater flexibility and greater ability to expand with temperature are desirable in the annular connection region 5*d* so as to be able to track the deformations that occur in the metal upstream rotor segment 5*a* during high-speed rotation of the rotor and while it is heating up.

Thus, in the annular connection region 5*d*, the organic matrix composite material of the Holweck skirt presents mechanical and thermal characteristics that are close to those of the metal or alloy constituting the upstream rotor segment 5*a*.

Conversely, in the downstream region of the skirt 5*e*, the organic matrix composite material presents characteristics that are more appropriate to withstanding the mechanical stresses that result in this downstream region 5*e* of the skirt from the high-speed rotation of the rotor in operation.

In practice, the fiber reinforcing structure of the Holweck type skirt downstream segment 5*c* comprises long fibers wound helically in the periphery of the skirt. The fibers are embedded in the resin, the resin being polymerized.

Figure 11:
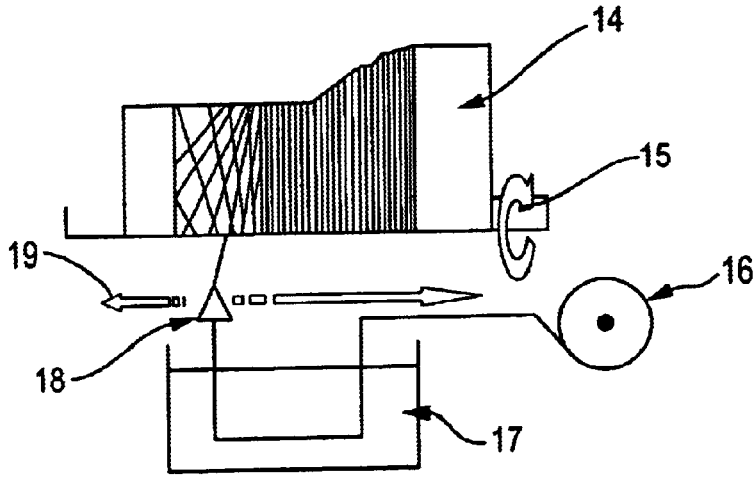
FIG. 11 shows the method of the invention for making a Holweck skirt out of composite material.

Reference can be made to FIG. 11 which is a diagram showing a method of making a skirt out of resin reinforced by long fibers that are helically-wound: a mandrel 14 is rotated about a shaft 15, and the mandrel presents an outside surface of shape that determines the shape of the skirt to be made. The reinforcing fibers are in the form of roving wound on a reel 16. The roving is taken from the reel 16, passes through a resin bath 17 and is guided by a thread guide 18 causing it to be wound helically on the mandrel 14 as the mandrel rotates. Depending on the relative speed of rotation of the shaft 15 and the speed in longitudinal translation of thread guide 18 as represented by arrow 19, the roving is placed on the mandrel 14 in a matrix at a pitch that can be selected by the operator.

Figure 4:
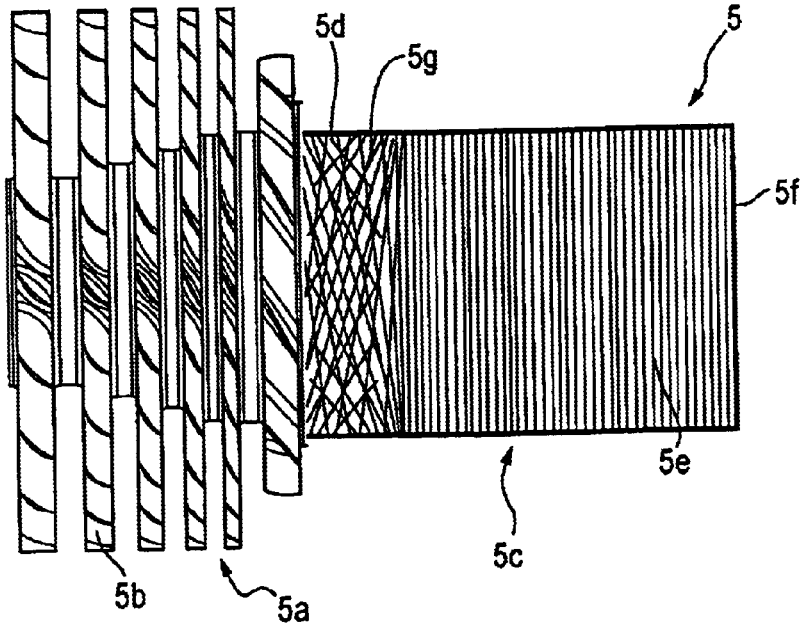
FIG. 4 is a diagrammatic side view showing the rotor structure in a first embodiment of the present invention.

FIG. 4 shows a first embodiment of a rotor 5 of the present invention.

In this embodiment, the rotor 5 comprises the upstream rotor segment 5*a* made of metal with blades such as the blade 5*b*, and comprises the downstream rotor segment 5*c* in the form of a Holweck type tubular cylindrical skirt.

The annular connection region 5*d* and a transition region 5*g* adjacent thereto have internal reinforcing structures such that their mechanical and thermal characteristics are close to those of the metal or alloy constituting the upstream rotor segment 5*a*. For this purpose, the reinforcing structure comprises long fibers wound helically at a relatively large pitch, the fibers making an angle greater than 0° relative to the transverse plane, for example making an angle of 5° to 20° depending on the looked-for mechanical properties. In the downstream skirt region 5*e*, the long fibers are wound helically with an angle close to 0°, forming touching turns, thereby significantly improving the mechanical strength of the skirt.

Figure 5:
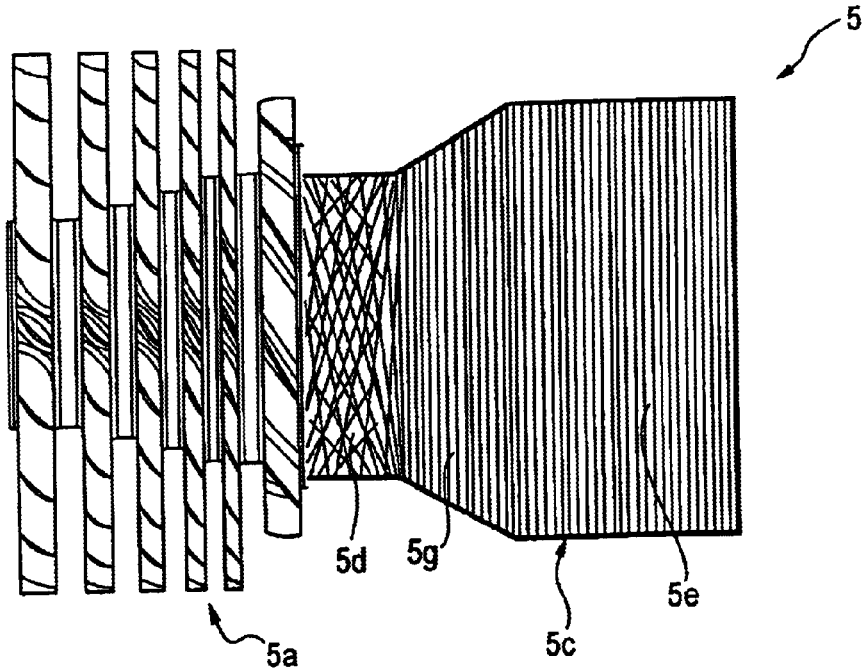
FIG. 5 is a diagrammatic side view showing the rotor structure in a second embodiment of the present invention.

FIG. 5 shows a preferred embodiment of the rotor 5 for a turbo/drag pump of the present invention. The rotor 5 has an upstream rotor segment 5*a*, e.g. a segment that is identical in structure with that of the embodiment shown in FIG. 4, and a downstream rotor segment 5*c* of diameter that varies as a function of position considered along the longitudinal axis: the skirt of the downstream rotor segment 5*c* comprises the annular connection region 5*d*, the cylindrical downstream skirt segment 5*e* of diameter greater than that of the annular connection region 5*d*, and an intermediate transition region 5*g* of progressively increasing diameter making the connection between the cylindrical annular connection region 5*d* and the cylindrical downstream skirt segment 5*e*.

In this second embodiment, the annular connection region 5*d* has reinforcing fibers at a non-zero angle relative to the transverse plane, while the downstream skirt segment 5*e*, and possibly also the intermediate transition region 5*g*, have touching fibers making an angle close to 0° with the transverse plane.

Figure 6:
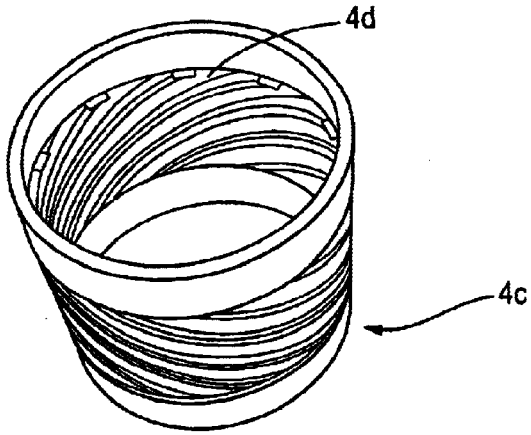
FIG. 6 is a perspective view showing the structure of the Holweck stage of the stator surrounding the skirt of the rotor of the invention.

Because of the reinforcement provided by the fibers at a zero angle, the cylindrical downstream skirt segment 5*e* can have a diameter that is significantly increased, thereby increasing the tangential speed of the skirt relative to the stator for given angular speed of rotation of the rotor, thus making it possible to increase the number of grooves 4*d* in the Holweck stator segment 4*c* (FIG. 6).

Figure 3:
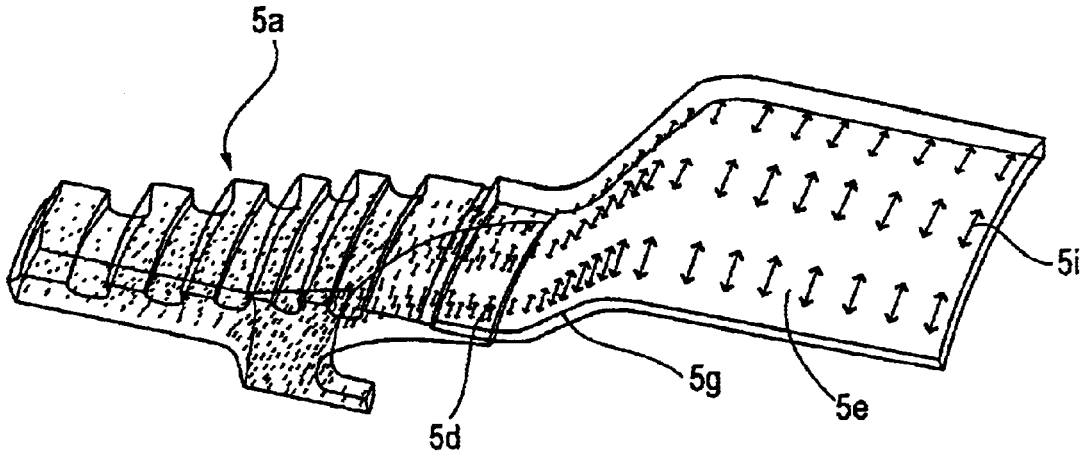
FIG. 3 shows how mechanical stresses are distributed over the FIG. 2 rotor sector, with the blades of the turbine stage being removed.

The advantage of this composite skirt structure is explained with reference to FIG. 3. This figure shows the mechanical stresses to which the rotor is subjected during high-speed rotation of the rotor: in the annular connection region 5*d*, the stresses are relatively small, whereas in the downstream skirt segment 5*e* the stresses represented by the arrows 5*i* are much larger, being three to four times greater in the embodiment shown in this figure. In the intermediate transition region 5*g*, the stresses increase gradually on approaching the downstream skirt segment 5*e*. Thus, in the annular connection region 5*d*, it is possible to place the fibers in such a manner as to confer a degree of flexibility and a certain ability to expand thermally to the composite material of the skirt, thereby enabling it to track changes in the dimensions of the upstream rotor segment 5*a* which is made of metal. In contrast, in order to be able to withstand the much greater mechanical stresses that occur in the downstream skirt segment 5*e*, it is necessary to place the reinforcing fibers in such a manner as to ensure that the skirt is rigid, properly concentric, and presents relatively good resistance to vibration.

Figure 9:
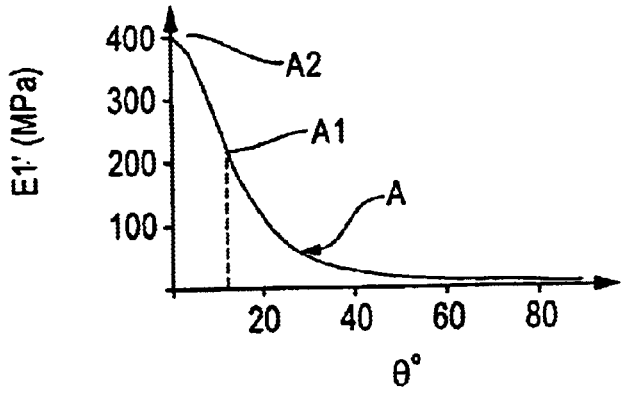
FIG. 9 shows how Young's modulus of the skirt varies as a function of fiber orientation relative to the plane extending transversely to the Holweck skirt.
Figure 10:
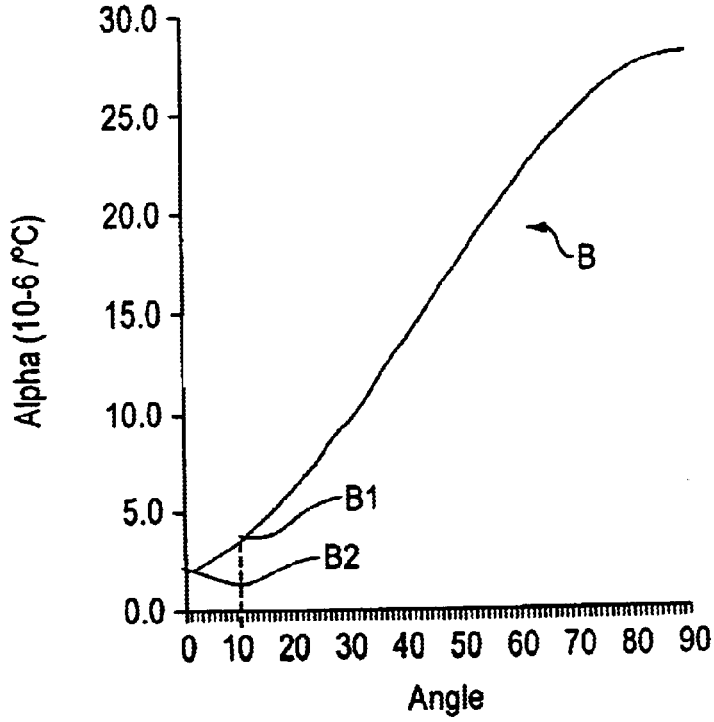
FIG. 10 shows how the coefficient of thermal expansion of the composite material varies as a function of the angle made by the fibers relative to the plane extending transversely to the Holweck skirt.

FIGS. 9 and 10 show the effect of the angle made by the fibers relative to the plane extending transversely to the skirt, firstly on mechanical strength as evaluated in terms of the longitudinal Young's modulus, and secondly by the coefficient of thermal expansion.

Curve A in FIG. 9 shows that Young's modulus is at a maximum A2 for an angle of 0°, i.e. when the fibers lie in a transverse plane. Young's modulus falls off quickly with increasing fiber angle up to an angle of about 20°, after which it falls off more slowly with increasing angle.

Curve B in FIG. 10 shows that the coefficient of thermal expansion increases regularly with increasing angle between the fibers and the transverse plane.

Thus, in the annular connection region 5*d* (FIGS. 4 and 5), a fiber angle is selected that is greater than 0°, for example an angle of 10° so as to be at point A1 on curve A in FIG. 9 and at point B1 on curve B in FIG. 10: relatively small Young's modulus and relatively high coefficient of thermal expansion. In contrast, in the downstream region 5*e* of the skirt (FIGS. 4 and 5), a fiber angle close to 0° is selected so as to be at point A2 on curve A in FIG. 9 and at point B2 on curve B in FIG. 10: maximum Young's modulus and minimum coefficient of thermal expansion.

In these two embodiments of fiber angle varying relative to the transverse plane, a difficulty lies in the fact that the skirt segment that is to present mechanical characteristics of flexibility occupies one end of the skirt, i.e. the annular connection region 5*d*. In this region, the fibers need to present a non-zero angle relative to the transverse plane, and these fibers need to be wound in a plurality of layers in order to provide sufficient reinforcement. Thus, when a fiber is wound helically towards the upstream end of the annular connection region 5*d*, the fiber makes an angle relative to the end of the skirt so it is necessary to move the thread guide in the opposite direction as soon as the fiber reaches this end. It is not easy to reverse the winding direction, so it is necessary to find means for facilitating this operation.

Figure 12:
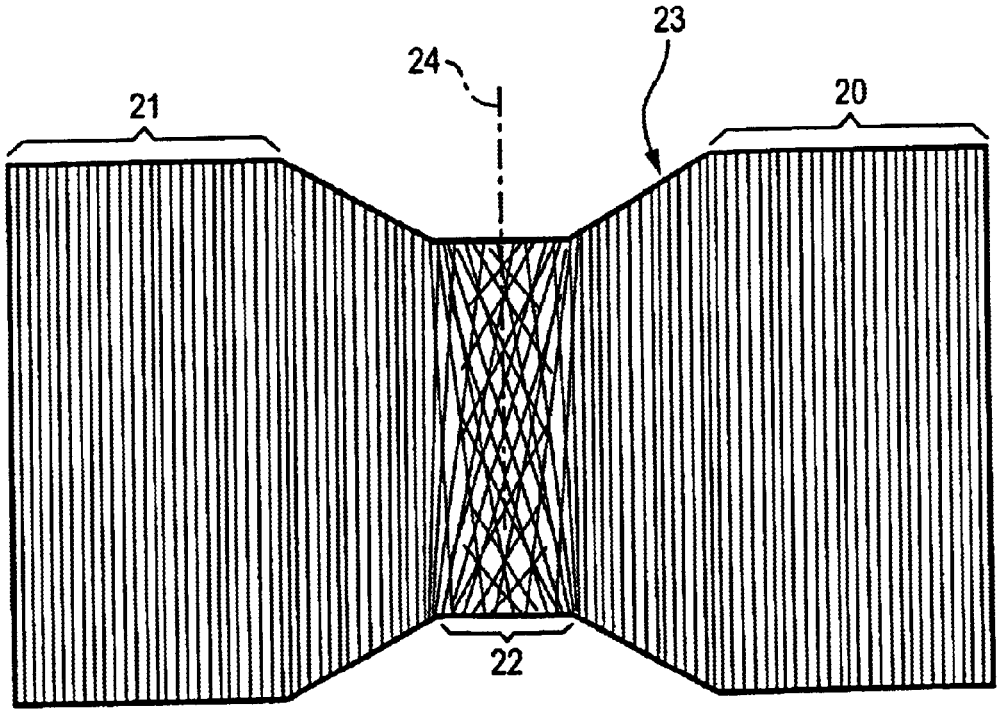
FIG. 12 shows the preferred method of the invention for making a Holweck skirt.

The invention provides such means by a special method of making a Holweck type skirt for a turbo/drag vacuum pump, the method comprising:

a/ a step consisting in helically winding long fibers on a mandrel to make a winding at an angle close to 0° in regions 20 and 21 (FIG. 12) that are adjacent to the two ends of the mandrel, and a winding at an angle greater than 0° in the middle region 22 of the mandrel, b/ a step of applying and hardening resin on the mandrel carrying the helically wound fibers, and c/ a step consisting in cutting the resulting sleeve 23 transversely in the middle 24 of its middle region 22, thus obtaining two skirts that are identical, providing the mandrel is itself initially symmetrical about its middle region 22.

During the step of cutting the middle region 22, the fibers that are wound helically at an angle greater than 0° in said middle region 22 are themselves cut. This does not spoil the mechanical qualities of the resulting skirt. On the contrary, this makes it possible to achieve a high degree of regularity in the winding of the fibers, and thus a high degree of regularity in the mechanical properties of the skirt in the annular connection region.

In the embodiments described above, the mechanical properties of the composite material are obtained by modulating the helical pitch with which the fibers are wound, i.e. the angle between the turns of the fibers and the transverse plane.

It is also possible for the long fibers to be wound helically and coated in resin while keeping the helix at a pitch that is constant.

Figure 7:
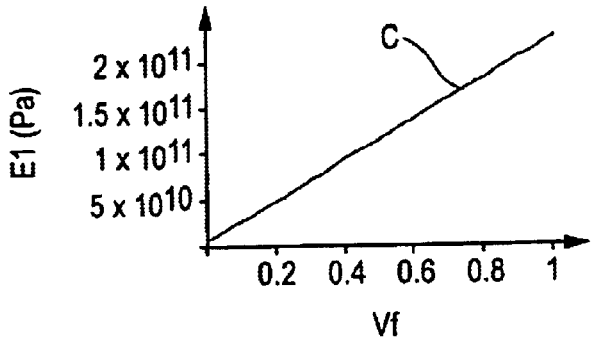
FIGS. 7 and 8 are graphs plotting Young's modulus respectively in the longitudinal direction and in the transverse direction relative to the fibers as a function of the quantity of fibers in the composite material.
Figure 8:
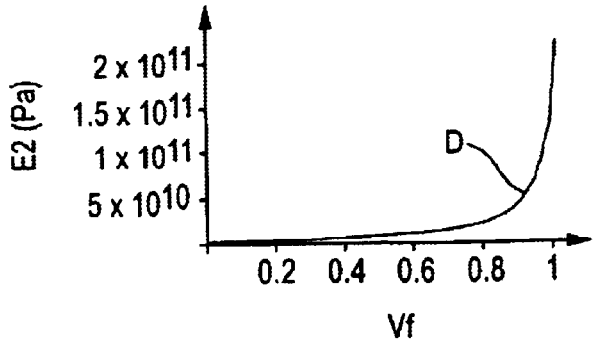

Under such circumstances, the amount of resin that is applied varies depending on the longitudinal region of the skirt under consideration. For example, in the annular connection region 5*d*, a greater resin fraction is applied, while in the downstream region of the skirt 5*e*, a smaller resin fraction is applied. Mechanical strength is thus increased in the downstream skirt segment 5*e* while flexibility is increased in the annular connection region 5*d*, as shown in FIGS. 7 and 8 which plot variations in longitudinal Young's modulus (curve C) and in transverse Young's modulus (curve D) as a function of fiber fraction (1 minus the resin fraction).

Where necessary, and depending on the properties desired for the skirt, it is possible to vary both the helical pitch and the resin fraction depending on the longitudinal region of the skirt under consideration.

The present invention is not limited to the embodiments described specifically above, but it includes the diverse variants and generalizations coming within the ambit of the following claims.

What is claimed is:

1. A turbo/drag vacuum pump comprising a rotor having an upstream rotor segment of a turbine type and a downstream rotor segment in the form of a Holweck type skirt, the upstream rotor segment being made of metal or alloy, the downstream rotor segment being made of organic matrix composite material, and the downstream rotor segment being connected to the upstream rotor segment via an annular connection region, wherein:

the downstream rotor segment comprising a Holweck type skirt made of organic matrix composite material has a fiber reinforcing structure imparting mechanical characteristics to the Holweck skirt that vary as a function of the longitudinal region under consideration of the skirt, in the annular connection region, the organic matrix composite material presents mechanical and thermal characteristics close to those of the metal or alloy constituting the upstream rotor segment, and in the downstream region of the skirt, the organic matrix composite material presents characteristics that are more suitable for withstanding the high mechanical stresses that result in this downstream region of the skirt from the high-speed rotation of the rotor in operation.

2. A turbo/drag vacuum pump according to claim 1, wherein the reinforcing structure comprises long fibers wound helically at constant pitch and coated in resin, the resin fraction varying depending on the longitudinal region under consideration of the skirt.

3. A turbo/drag vacuum pump according to claim 1, wherein the reinforcing structure comprises helically-wound long fibers coated in resin at a constant resin fraction, the pitch of the helix varying depending on the longitudinal region under consideration of the skirt.

4. A turbo/drag vacuum pump according to claim 1, wherein the reinforcing structure comprises helically-wound long fibers coated in resin, the pitch of the helix and the resin fraction both varying depending on the longitudinal region under consideration of the skirt.

5. A turbo/drag vacuum pump according to claim 3, wherein the helix presents an angle close to 0° in the downstream region of the skirt, and presents an angle greater than 0° in and close to the annular connection region.

6. A turbo/drag vacuum pump according to claim 1, wherein the skirt is cylindrical.

7. A turbo/drag vacuum pump according to claim 1, wherein the skirt comprises a cylindrical downstream skirt segment of diameter greater than that of the annular connection region, and an intermediate transition region between the annular connection region and the downstream skirt segment.

8. A turbo/drag vacuum pump according to claim 1, wherein the reinforcing fibers are cut along the upstream edge of the skirt.

9. A method of making a Holweck type skirt for a turbo/drag pump according to claim 5, the method comprising:

a/ a step consisting in helically winding long fibers on a mandrel, winding at a pitch angle close to 0° in the regions adjacent to the two ends of the mandrel and winding at a pitch angle greater than 0° in the middle region of the mandrel, b/ a step of applying and hardening the resin on the mandrel carrying the helically-wound fibers, and c/ a step consisting in cutting the sleeve as obtained in this way in its middle region in order to obtain two skirts.

* * * * *